US011501937B2

(12) United States Patent
Li et al.

(10) Patent No.: US 11,501,937 B2
(45) Date of Patent: Nov. 15, 2022

(54) MECHANICAL OPERATING ASSEMBLY FOR A BISTABLE RELAY AND A BISTABLE RELAY ASSEMBLY

(71) Applicant: Schneider Electric Industries SAS, Rueil-Malmaison (FR)

(72) Inventors: Shaofan Li, Shanghai (CN); Daniel Sinthomez, Eybens (FR); Xiaoqiang Li, Shanghai (CN); Ming Dai, Shanghai (CN); Franck Becker, Shanghai (CN)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 17/377,960

(22) Filed: Jul. 16, 2021

(65) Prior Publication Data

US 2022/0020548 A1 Jan. 20, 2022

(30) Foreign Application Priority Data

Jul. 16, 2020 (CN) ..... 202010686582.9

(51) Int. Cl.
*H01H 47/04* (2006.01)
*H01H 73/04* (2006.01)

(52) U.S. Cl.
CPC ..... *H01H 47/043* (2013.01); *H01H 73/045* (2013.01); *H01H 2235/01* (2013.01)

(58) Field of Classification Search
CPC . H01H 47/043; H01H 73/045; H01H 2235/01
(Continued)

(56) References Cited

U.S. PATENT DOCUMENTS 4,344,103 A * 8/1982 Nagamoto ..... H01H 51/2272 335/133
7,161,104 B2 1/2007 Bergh et al.
(Continued)

FOREIGN PATENT DOCUMENTS

CN 207217425 U 4/2018
CN 106876217 B 11/2019

OTHER PUBLICATIONS

Extended European Search Report dated Nov. 30, 2021 for corresponding European Patent Application No. 21305832.4—1202, 12 pages.

*Primary Examiner* — Yemane Mehari
(74) *Attorney, Agent, or Firm* — Locke Lord LLP

(57) ABSTRACT

The present invention relates to a mechanical operating assembly for a bistable relay and a bistable relay assembly. The mechanical operating assembly comprises: an actuating mechanism mounted to a bracket, including an actuating member and a first transmitting member which is connected to a paddle, the actuating member is movable between an initial position in which the actuating member is not in contact with the first transmitting member and an actuating position, when the actuating member moves from the initial position to the actuating position, the actuating member contacts the first transmitting member; a reset mechanism mounted to the bracket, including a reset member and a second transmitting member which is in contact with the first transmitting member, the reset member is movable between an initial position and a reset position, the reset member contacts the second transmitting member when moving from the initial position to the reset position.

13 Claims, 7 Drawing Sheets

(58) Field of Classification Search
USPC ..... 361/160
See application file for complete search history.

(56) References Cited

U.S. PATENT DOCUMENTS

| | | | | |
|---|---|---|---|---|
| 9,053,885 | B2 * | 6/2015 | Gassmann | H01H 1/26 |
| 10,366,852 | B2 * | 7/2019 | Birner | H01H 50/36 |
| 2002/0030569 | A1 * | 3/2002 | Castonguay | H01H 73/045 335/172 |
| 2011/0156847 | A1 | 6/2011 | Sullivan et al. | |
| 2011/0267157 | A1 * | 11/2011 | Kalmbach | H01H 51/2209 335/78 |
| 2022/0020548 | A1 * | 1/2022 | Li | H01H 73/045 |

* cited by examiner

MECHANICAL OPERATING ASSEMBLY FOR A BISTABLE RELAY AND A BISTABLE RELAY ASSEMBLY

TECHNICAL FIELD

The present invention relates to a mechanical operating assembly for a bistable relay and a bistable relay assembly.

BACKGROUND

In electronic thermal protection relays, bistable relays are required to switch signals. In working state, the switching of the bistable relay is controlled by electronic signals, but when the product needs to be tested for wiring, or the product has tripped and needs to be reset manually, the action of the bistable relay needs to be controlled through a mechanical connection.

SUMMARY

The present invention provides a mechanical operating assembly for a bistable relay, including: a bracket being mounted to the bistable relay; an actuating mechanism being mounted to the bracket, including an actuating member and a first transmitting member, wherein the first transmitting member is connected to a paddle of the bistable relay, and the actuating member is configured to move the first transmitting member when actuated, thereby moving the paddle of the bistable relay, such that the bistable relay is switched from a first state to a second state; a reset mechanism being mounted to the bracket, including a reset member and a second transmitting member, wherein the second transmitting member is in contact with the first transmitting member, and the reset member is movable between an initial position in which the reset member is not in contact with the second transmitting member, and a reset position, wherein when the reset member moves from the initial position to the reset position, the reset member is configured to contact the second transmitting member, so that the second transmitting member moves correspondingly, and the first transmitting member drives the paddle of the bistable relay to move, such that the bistable relay is switched from the second state to the first state, and wherein after the reset member reaches the reset position, the reset member is configured to be out of contact with the second transmitting member.

Advantageously, the actuating member is movable between the initial position in which the actuating member is not in contact with the first transmitting member, and an actuating position, wherein, when the actuating member moves from the initial position to the actuating position, the actuating member is configured to be in contact with the first transmitting member, so that the first transmitting member drives the paddles of the bistable relay to move to switch the bistable relay from the first state to the second state.

Advantageously, the first transmitting member is mounted on the bracket in a translation manner, wherein the actuating member includes a first inclined surface, and the first transmitting member includes a second inclined surface, wherein when the actuating member moves from the initial position to the actuating position, the first inclined surface abuts against the second inclined surface and pushes the first transmitting member in a first translation direction to switch the bistable relay from the first state to the second state.

Advantageously, the actuating mechanism further includes a first reset spring, which is provided between the actuating member and the bracket, wherein after the actuating member overcomes the elastic force of the first reset spring and moves from the initial position to the actuating position, the actuating member is configured to return to its initial position through the elastic force of the first reset spring.

Advantageously, the first transmitting member further includes an indicator, and after the first transmitting member translates in a horizontal direction to switch the bistable relay from the first state to the second state, the indicator is exposed through a window in a housing to indicate that the bistable relay is in the second state, said housing surrounding the bistable relay and the mechanical operating assembly.

Advantageously, the reset member includes a first matching member, wherein the second transmitting member is rotatably mounted on the bracket, and includes a second matching member, wherein when the reset member moves from the initial position to the reset position, the first matching member abuts against the second matching member and pushes the second transmitting member to rotate in the first direction, such that the first transmitting member moves in a second translation direction opposite to the first translation direction, causing the bistable relay to switch from the second state to the first state.

Advantageously, the first matching member includes a third inclined surface, and when the reset member moves from the initial position to the reset position, the third inclined surface abuts against the second matching member and pushes the second transmitting member to rotate in the first direction.

Advantageously, the reset mechanism further includes a second reset spring, which is disposed between the second transmitting member and the bracket; and a third reset spring which is disposed between the reset member and the bracket, wherein when the reset member overcomes the elastic force of the third reset spring and moves from the initial position to the reset position, the second transmitting member overcomes the elastic force of the second reset spring and rotates in the first direction.

Advantageously, after the reset member reaches the reset position, the third inclined surface is configured to disengage from abutment with the second matching member, and the second transmitting member is configured to return to its initial position under the action of the second reset spring.

Advantageously, the reset mechanism further includes a third reset spring, which is disposed between the reset member and the bracket, wherein after the reset member reaches the reset position, the reset member is configured to return to its initial position through the third reset spring.

Advantageously, the first matching member further includes a curved surface opposite to the third inclined surface, wherein during the process that the reset member returns to its initial position through the third reset spring, the second matching member of the second transmitting member moves to the initial position along the curved surface.

Advantageously, the first transmitting member is rotatably mounted on the bracket, wherein when the actuating member moves from the initial position to the actuating position, the actuating member is configured to abut against the first transmitting member to rotate the first transmitting member, thereby driving the bistable relay to switch from the first state to the second state.

The present invention also provides a bistable relay assembly, which includes a bistable relay and the above-mentioned mechanical operating assembly.

BRIEF DESCRIPTION OF THE FIGURES

The advantages and objectives of the present invention can be better understood from the preferred embodiments of the present invention described in detail below in conjunction with the accompanying figures. In order to better show the relationship of the various components in the drawings, the drawings are not drawn to scale. In these figures.

DETAILED DESCRIPTION

Figure 1:
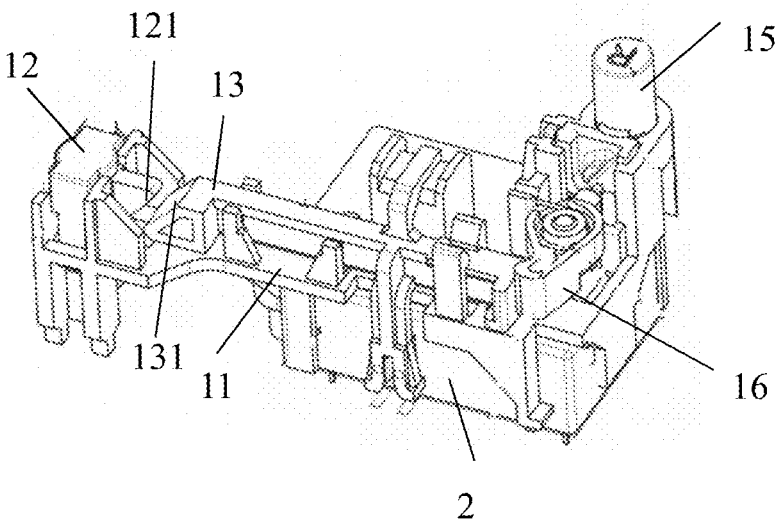
FIG. 1 shows a perspective view of a bistable relay assembly according to the present invention, in which an actuating member of an actuating mechanism is in an initial position.

Various embodiments according to the present invention will be described in detail with reference to the accompanying figures. Here, it should be noted that in the figures, the same reference numerals are given to constituent parts that basically have the same or similar structure and function, and repeated descriptions about them will be omitted. Unless otherwise specified, the terms "first direction", "second direction", "rotating direction" etc. in this text are all described with respect to the drawings of the present invention. The term "comprises A, B, C, etc. in sequence" only indicates the sequence of the included components A, B, C, etc., and does not exclude the possibility of including other components between A and B and/or between B and C. The description of "first" and its variants is only used for distinguishing the various components, and does not limit the scope of the present invention, without departing from the scope of the present invention, the "first component" can be written as "second component", etc.

The drawings in this specification are schematic views to assist in explaining the concept of the present invention, and schematically show the shape of each part and the relationship between them.

Hereinafter, referring to FIGS. 1 to 14, the preferred embodiment according to the present invention will be described in detail.

Figure 2:
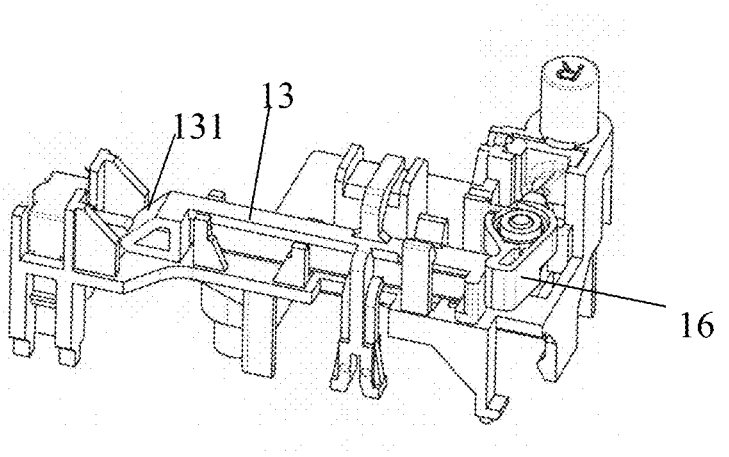
FIG. 2 shows an exploded view of the bistable relay assembly according to the present invention, for clarity, the bistable relay is omitted.
Figure 3:
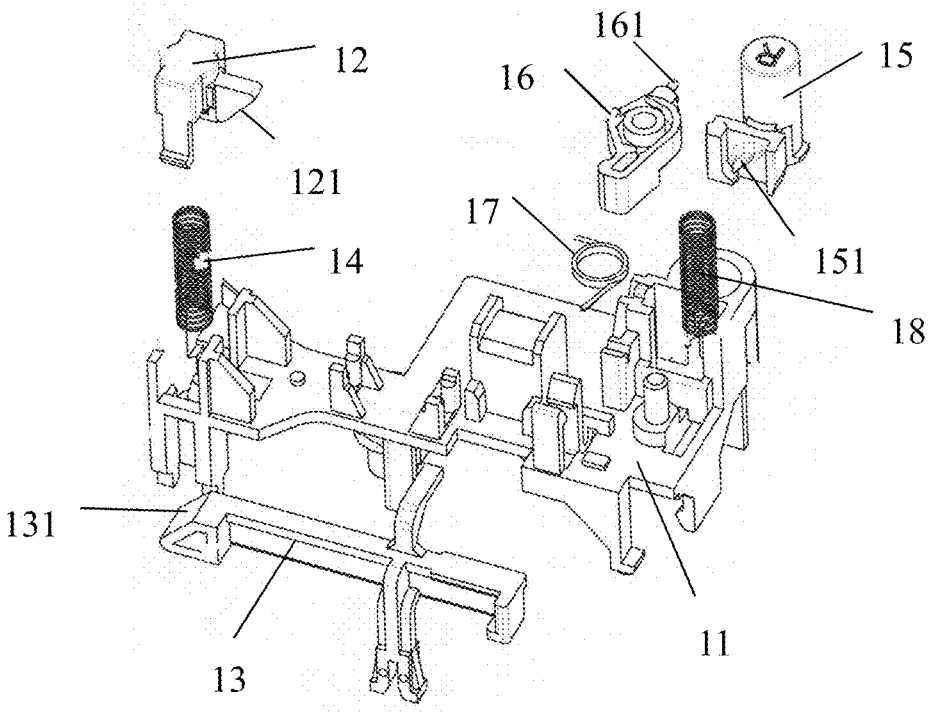
FIG. 3 shows a perspective view of the bistable relay assembly according to the present invention, in which the actuating member of the actuating mechanism is in an actuating position.

As shown in FIGS. 1 to 3, a mechanical operating assembly for a bistable relay is installed on the bistable relay. A bistable relay assembly includes a housing S, which accommodates the bistable relay 2 and the mechanical operating assembly 1. The mechanical operating assembly 1 includes a bracket 11 mounted to the bistable relay, an actuating mechanism, and a reset mechanism.

Figure 14:
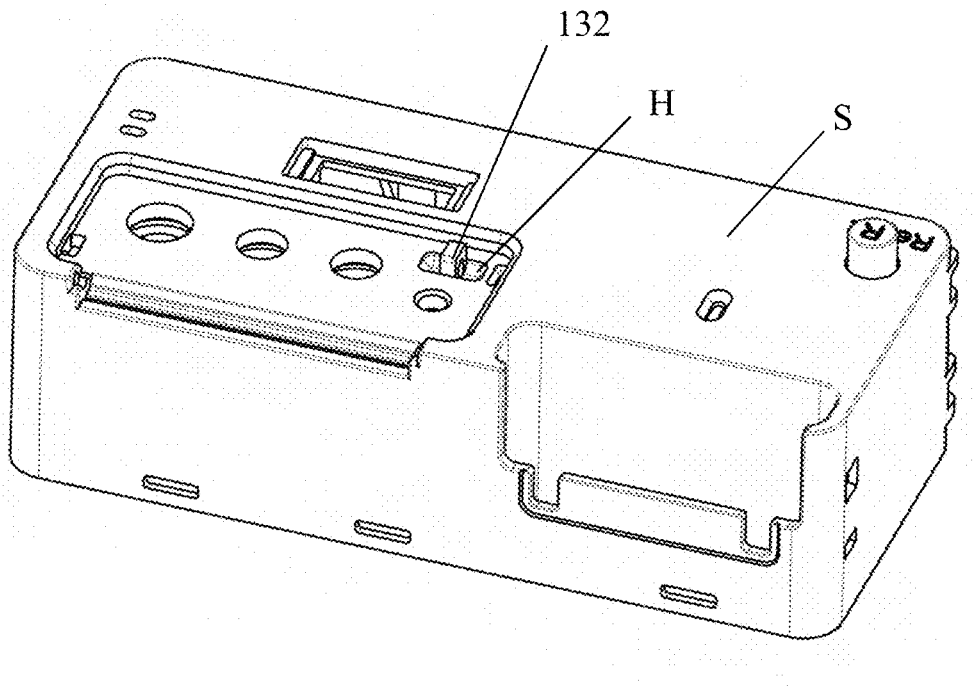
FIG. 14 shows a schematic view of the appearance of the bistable relay assembly, in which an indicator indicates that the bistable relay is in a second state.

The actuating mechanism includes an actuating member 12 and a first transmitting member 13, and the first transmitting member 13 is connected to a paddle of the bistable relay. The actuating member is moveable between an initial position (as shown in FIG. 1) in which the actuating member is not in contact with the first transmitting member, and an actuating position. In this embodiment, the first transmitting member 13 is mounted on the bracket in a translational manner, so that when the actuating member moves from the initial position to the actuating position (as shown in FIG. 3), the actuating member contacts the first transmitting member, and make the first transmitting member translate, which drives the paddle of the bistable relay to move correspondingly, so that the bistable relay is switched from a first state to a second state. The actuating member 12 has a first inclined surface 121, and the first transmitting member 13 has a second inclined surface 131 corresponding to the first inclined surface. In this embodiment, when the actuating member moves downward, the first inclined surface 121 abuts the second inclined surface 131, causing the first transmitting member to move to the right, which drives the paddle of the bistable relay to move, so that the bistable relay is switched from the first state to the second state. The first transmitting member 13 also includes an indicator 132 which is configured to be exposed through a window H in the housing (as shown in FIG. 14) after the first transmitting member translates to the right to switch the bistable relay from the first state to the second state, so that it can be visually observed that the bistable relay is in the second state. The actuating mechanism also includes a first reset spring 14 installed between the actuating member and the bracket, for returning the actuating member from the actuating position to the initial position.

Figure 4:
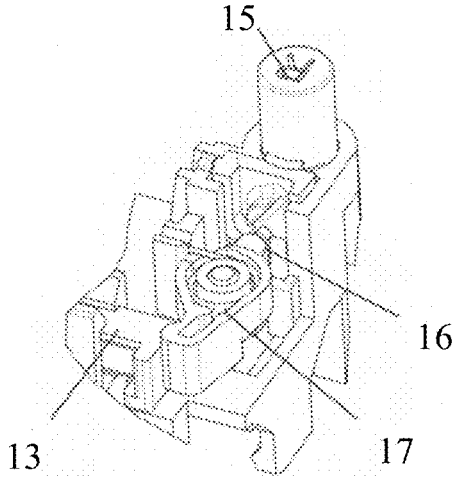
FIG. 4 shows an enlarged view of a reset mechanism of a mechanical operating assembly.

As shown in FIG. 4, the reset mechanism includes a reset member 15 and a second transmitting member 16. The reset member is movable between an initial position in which the reset member is not in contact with the second transmitting member and a reset position. In this embodiment, the second transmitting member is located below the reset member, and is rotatably mounted on the bracket, and is in contact with the first transmitting member. When the reset member moves downward and contacts the second transmitting member, the second transmitting member is pushed to rotate in a clockwise direction, which pushes the first transmitting member to move to the left, driving the paddle of the bistable relay to move, so that the bistable relay is switched from the first state to the second state. In the initial positions of the actuating member and the reset member, the movements of the first transmitting member and of the second transmitting member is not hindered by the actuating member and the reset member, and therefore, the actuating member and the reset member will not hinder the use of electrical signals to control the state switching of the bistable relay.

The reset member 15 has a first matching member 151, which includes a third inclined surface 152 and a curved surface 153 opposite to the third inclined surface. The second transmitting member includes a second matching member 161. When the reset member moves downward, the third inclined surface 151 contacts the second matching member 161 to push the second transmitting member to rotate in a clockwise direction.

The operating process of the reset mechanism will be described below with reference to FIGS. 5-12.

Figure 5:
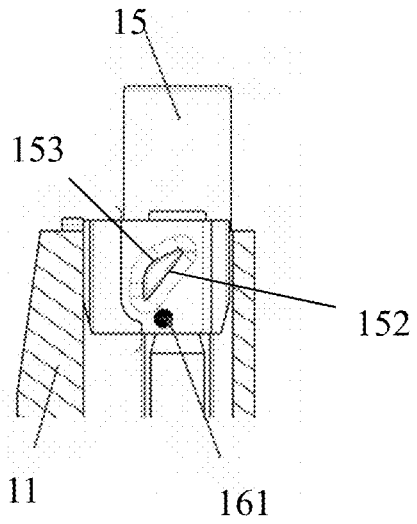
FIGS. 5-12 show the operating process of the reset mechanism of the mechanical operating assembly.
Figure 6:
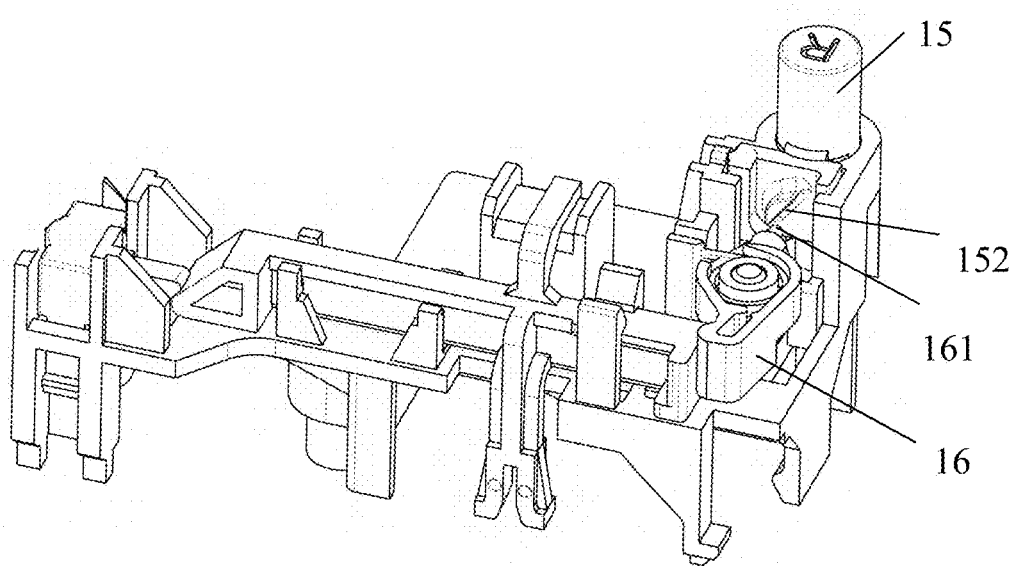

FIG. 5 shows a perspective view of the bistable relay assembly according to the present invention, wherein, the reset member of the reset mechanism is in the initial position. FIG. 6 is a schematic view of the reset mechanism corresponding to FIG. 5, showing the positional relationship between the first matching member of the reset member and the second matching member of the second transmitting member. It can be seen from the figure that, in the initial position of the reset member, the second matching member is located below the first matching member.

Figure 7:
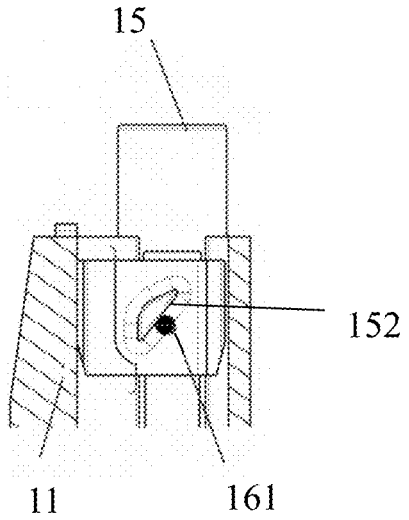
Figure 8:
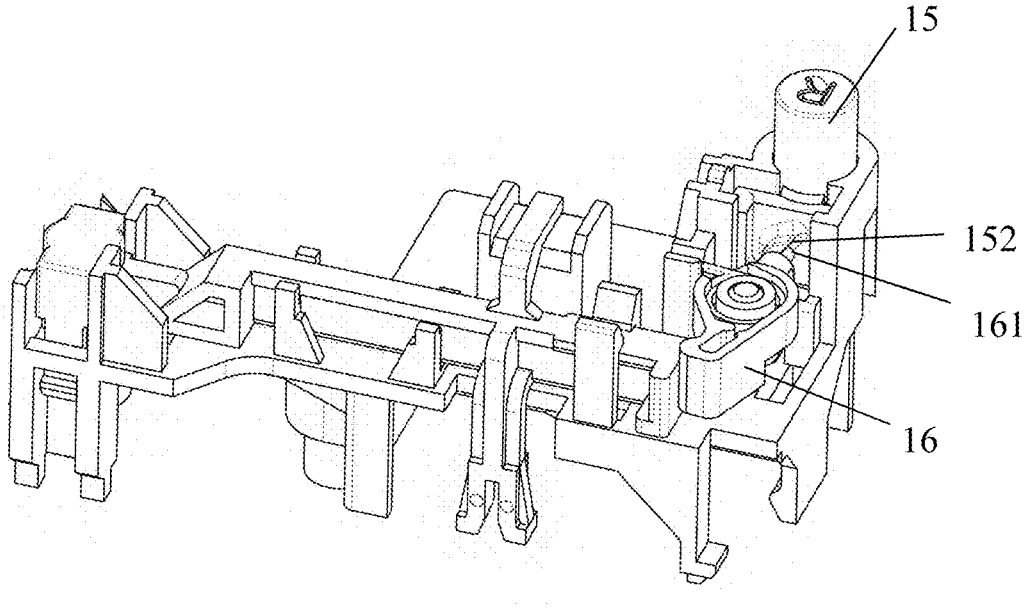

As shown in FIGS. 7 and 8, when the reset member is pressed downward, the third inclined surface of the first matching member abuts against the second matching member and pushes the second matching member (and thus the second transmitting member) to rotate in a clockwise direction, which causes the first transmitting member to move to the left, thereby driving the paddle of the bistable relay to move accordingly.

Figure 9:
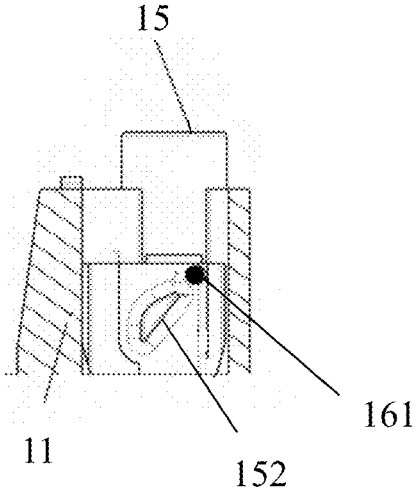
Figure 10:
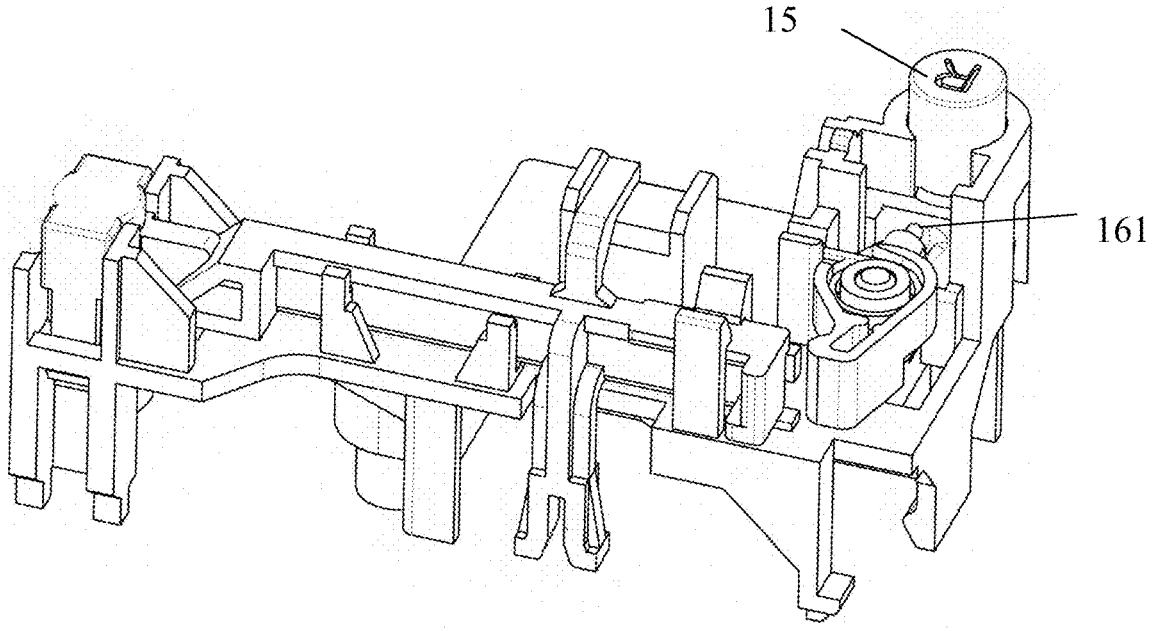
Figure 11:
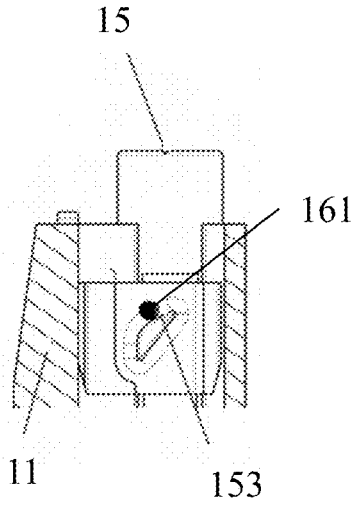
Figure 12:
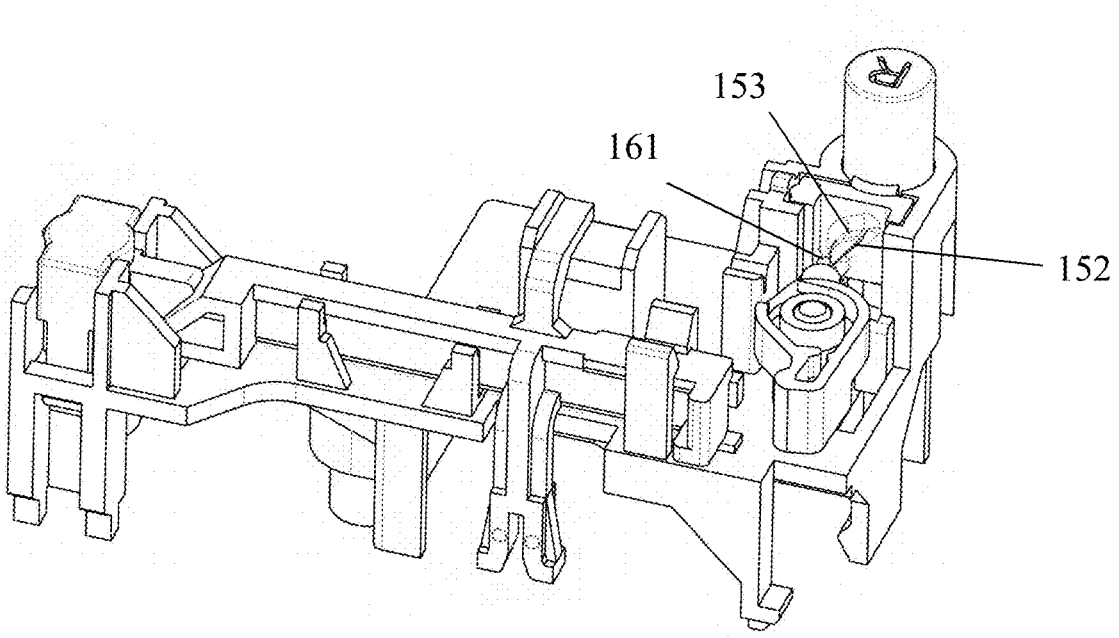

The reset member is pressed downward further to the reset position, as shown in FIGS. 9 and 10. The third inclined surface disengages from the abutment of the second matching member, and the second transmitting member can move freely without being hindered by the reset member, so that the second transmitting member is out of contact with the first transmitting member. A second reset spring 17 is provided between the second transmitting member and the bracket, and a third reset spring 18 is provided between the reset member and the bracket. The reset member moves from the reset position toward the initial position under the action of the third reset spring, and the second transmitting member moves in a counterclockwise direction along the curved surface under the action of the second reset spring, as shown in FIGS. 11 and 12, so that the reset member returns to the initial position, and the second transmitting member returns to the initial position.

Figure 13:
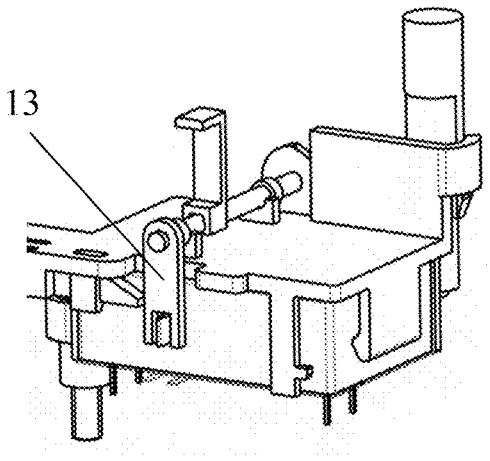
FIG. 13 shows a schematic view of another embodiment of a first transmitting member.

In the above embodiment, the first transmitting member is in the form of a push rod, which can translate on the bracket. Alternatively, as shown in FIG. 13, the first transmitting member may be in the form of a rotating rod, which rotates when pushed by the actuating member, thereby driving the paddle of the bistable relay to move. Similarly, the second transmitting member can also push the rotating rod to rotate, thereby driving the paddle of the bistable relay to move oppositely. For the sake of clarity, only the first transmitting member in the form of a rotating rod is shown in FIG. 13, and other related parts are omitted.

The above describes the mechanical operating assembly of the bistable relay according to the present invention. Through the mechanical operating assembly, the bistable relay can be controlled to perform state switching, and at the same time, in the entire cycle before and after switching, the control of the electrical signal on the state switching of the bistable relay will not be affected, which meets the requirements of free tripping.

Moreover, the technical features disclosed above are not limited to the disclosed combinations with other features, and those skilled in the art can also make other combinations between the technical features according to the purpose of the invention, so as to achieve the purpose of the present invention.

The invention claimed is:

1. A mechanical operating assembly for a bistable relay, wherein the mechanical operating assembly comprises:

a bracket being mounted to the bistable relay;

an actuating mechanism being mounted to the bracket, including an actuating member and a first transmitting member, wherein the first transmitting member is connected to a paddle of the bistable relay, and the actuating member is configured to move the first transmitting member when actuated, thereby moving the paddle of the bistable relay, such that the bistable relay is switched from a first state to a second state;

a reset mechanism being mounted to the bracket, including a reset member and a second transmitting member, wherein the second transmitting member is in contact with the first transmitting member, and the reset member is movable between an initial position in which the reset member is not in contact with the second transmitting member, and a reset position, wherein when the reset member moves from the initial position to the reset position, the reset member is configured to contact the second transmitting member, so that the second transmitting member moves correspondingly, and the first transmitting member drives the paddle of the bistable relay to move, such that the bistable relay is switched from the second state to the first state, and wherein after the reset member reaches the reset position, the reset member is configured to be out of contact with the second transmitting member.

2. A mechanical operating assembly according to claim 1, wherein the actuating member is movable between the initial position in which the actuating member is not in contact with the first transmitting member, and an actuating position, wherein, when the actuating member moves from the initial position to the actuating position, the actuating member is configured to be in contact with the first transmitting member, so that the first transmitting member drives the paddles of the bistable relay to move to switch the bistable relay from the first state to the second state.

3. A mechanical operating assembly according to claim 2, wherein the first transmitting member is mounted on the bracket in a translation manner, wherein the actuating member includes a first inclined surface, and the first transmitting member includes a second inclined surface, wherein when the actuating member moves from the initial position to the actuating position, the first inclined surface abuts against the second inclined surface and pushes the first transmitting member in a first translation direction to switch the bistable relay from the first state to the second state.

4. A mechanical operating assembly according to claim 3, wherein the actuating mechanism further includes a first reset spring, which is provided between the actuating member and the bracket, wherein after the actuating member overcomes the elastic force of the first reset spring and moves from the initial position to the actuating position, the actuating member is configured to return to its initial position through the elastic force of the first reset spring.

5. A mechanical operating assembly according to claim 3, wherein the first transmitting member further includes an indicator, and after the first transmitting member translates in a horizontal direction to switch the bistable relay from the first state to the second state, the indicator is exposed through a window in a housing to indicate that the bistable relay is in the second state, said housing surrounding the bistable relay and the mechanical operating assembly.

6. A mechanical operating assembly according to claim 3, wherein the reset member includes a first matching member, wherein the second transmitting member is rotatably mounted on the bracket, and includes a second matching member, wherein when the reset member moves from the initial position to the reset position, the first matching member abuts against the second matching member and pushes the second transmitting member to rotate in the first direction, such that the first transmitting member moves in a second translation direction opposite to the first translation direction, causing the bistable relay to switch from the second state to the first state.

7. A mechanical operating assembly according to claim 6, wherein the first matching member includes a third inclined surface, and when the reset member moves from the initial position to the reset position, the third inclined surface abuts against the second matching member and pushes the second transmitting member to rotate in the first direction.

8. A mechanical operating assembly according to claim 7, wherein the reset mechanism further includes a second reset spring, which is disposed between the second transmitting member and the bracket; and a third reset spring which is disposed between the reset member and the bracket, wherein when the reset member overcomes the elastic force of the third reset spring and moves from the initial position to the reset position, the second transmitting member overcomes the elastic force of the second reset spring and rotates in the first direction.

9. A mechanical operating assembly according to claim 8, wherein after the reset member reaches the reset position, the third inclined surface is configured to disengage from abutment with the second matching member, and the second transmitting member is configured to return to its initial position under the action of the second reset spring.

10. A mechanical operating assembly according to claim 9, wherein the reset mechanism further includes a third reset spring, which is disposed between the reset member and the bracket, wherein after the reset member reaches the reset position, the reset member is configured to return to its initial position through the third reset spring.

11. A mechanical operating assembly according to claim 10, wherein the first matching member further includes a curved surface opposite to the third inclined surface, wherein during the process that the reset member returns to its initial position through the third reset spring, the second matching member of the second transmitting member moves to the initial position along the curved surface.

12. A mechanical operating assembly according to claim 2, wherein the first transmitting member is rotatably mounted on the bracket, wherein when the actuating member moves from the initial position to the actuating position, the actuating member is configured to abut against the first transmitting member to rotate the first transmitting member, thereby driving the bistable relay to switch from the first state to the second state.

13. A bistable relay assembly, comprising a bistable relay and the mechanical operating assembly according to claim 1.

* * * * *